US005333920A

United States Patent [19]

de Rover

[11] Patent Number: 5,333,920

[45] Date of Patent: Aug. 2, 1994

[54] PANEL FOR CLOSING AN OPENING, AND CLIP SYSTEM FOR USE AS A PART THEREOF

[75] Inventor: Jan de Rover, Smilde, Netherlands

[73] Assignee: Machinefabriek en Handelmaatschappij Winel B.V., Assen, Netherlands

[21] Appl. No.: 9,628

[22] Filed: Jan. 21, 1993

[30] Foreign Application Priority Data

Jan. 21, 1992 [EP] European Pat. Off. ..... 92200174.8

[51] Int. Cl.[5] ..... E05C 3/16

[52] U.S. Cl. ..... 292/48; 292/52; 292/240

[58] Field of Search ..... 292/26, 46, 48, 52, 292/53, 240; 114/117

[56] References Cited

U.S. PATENT DOCUMENTS

| | | | |
|---|---|---|---|
| 2,460,961 | 2/1949 | Wilson | 292/48 |
| 2,557,670 | 6/1951 | Luft | 292/240 X |
| 2,753,020 | 7/1956 | Ware, Jr. | 292/48 X |
| 2,789,851 | 4/1957 | Lickteig | 292/240 X |
| 3,362,573 | 1/1968 | Wales, Jr. | 292/48 X |
| 5,086,587 | 2/1992 | Andrews | 292/240 X |

FOREIGN PATENT DOCUMENTS

| | | | |
|---|---|---|---|
| 630669 | 1/1938 | Fed. Rep. of Germany . | |
| 375410 | 7/1907 | France . | |
| 432413 | 12/1911 | France . | |
| 866063 | 6/1941 | France . | |
| 1016726 | 11/1952 | France . | |
| 757676 | 8/1980 | U.S.S.R. | 292/48 |

OTHER PUBLICATIONS

Product information sheet Vaerftstandard DVS #43009 Feb. 1976.

*Primary Examiner*—Rodney M. Lindsey
*Attorney, Agent, or Firm*—George A. Skoler

[57] ABSTRACT

A clip system for clamping a panel element against a rebate comprises a bolt which is movable between a first position for clamping the panel element against a rebate and a second position for releasing the panel element, and an operating mechanism for moving the bolt. According to the invention, depending on the position of the bolt, there is a variable transmission ratio between the operating mechanism and the bolt, with a reduction which increases as the bolt in a path near the first position nears said first position. Operation of the bolt consequently requires little force and can be carried out with a short movement. The clip system can be achieved by a simple construction requiring little maintenance.

15 Claims, 4 Drawing Sheets

PANEL FOR CLOSING AN OPENING, AND CLIP SYSTEM FOR USE AS A PART THEREOF

BACKGROUND OF THE INVENTION

The invention relates to a panel for closing an opening, with a panel element and a clip system for clamping said panel element against a rebate of the opening, comprising at least one bolt which is movable between a first position for clamping the panel element against the rebate and a second position for releasing the panel element, and an operating mechanism for moving said bolt.

Such a panel is known as a "clip door", which is used in ships for closing passages in walls and partitions of the ship. An important requirement of such a panel is that it should be able to close the passage reliably and in a watertight manner. For this, the panel element can be clamped against the rebate, and a flexible sealing section is clamped between the edge of the panel element and the edge of the passage.

The bolt and the rebate are designed in such a way that the panel element is clamped against the rebate when the bolt is moved from the first to the second position.

For this, the bolt in the known clip door swivels about an axis at right angles to the plane of the panel element, and the bolt and the rebate are provided with clip surfaces running at corresponding angles relative to the plane of the panel element or of the wall in which the passage is provided. When the bolt is moved from the second to the first position, said clip surfaces knock against each other and are pushed along each other, so that the panel element is clamped against the rebate.

A disadvantage of this known panel is that operation of the clip system requires great force.

The problem of the great force required to operate the bolt is further aggravated in panels with several bolts which are provided with an operating mechanism for operating at least a number of the bolts, in order to ensure that said bolts are always operated when the panel is being closed.

An example of a panel with an operating mechanism for operating several bolts is the so-called coupled clip door, in which one of the bolts is firmly connected to an operating mechanism, and that one bolt is coupled to other bolts, so that they can be operated simultaneously by the operating mechanism. Operation of the clip system of such a panel requires extremely great force. Furthermore, the coupling mechanism requires a great deal of maintenance, in particular as regards lubrication, otherwise operation of the system takes such force that the door can no longer be clamped properly against the rebate.

In another example of a panel with an operating mechanism for operating several bolts, the so-called central clip door, the door is provided with a central operating mechanism with a reduction, which is coupled to several bolts. The operating mechanism is in this case in the form of a hand wheel coupled to the reduction which comprises a gear wheel with a smaller diameter than the hand wheel and a gear rack. The gear rack is in turn coupled to the bolts. This door requires less force to operate the operating mechanism than in the case of the coupled clip door. Disadvantages of a central clip door are, however, that the operating mechanism is an unwieldy, expensive construction with a great mass, turning the hand wheel requires several actions, it cannot be seen from the position of the operating element whether or not the door is closed, and the operating mechanism has to be regularly inspected and overhauled.

SUMMARY OF THE INVENTION

It is an object of the invention to provide a panel which can be clamped against a rebate with relatively little force, and in which the operating mechanism need be moved only over a relatively short working distance.

According to the present invention, this object is achieved by providing a clip door of the above-described type, having a transmission ratio which is variable depending on the position of said bolt between the operating mechanism and the bolt, with a reduction which increases as the bolt in a path near the first position approaches the first position.

In the case of the panel according to the invention, when the operating mechanism is moved, the reduction between the operating mechanism and the bolt increases as the bolt meets with more resistance through forcing the panel element with increasing force towards the edge of the passage. This means that operating the bolt requires a limited maximum force. The reduction is, however, relatively short in a part of the path in which the bolt meets little resistance during movement. The operating mechanism consequently has to be moved only over a short working distance when the bolt is being closed, so that the operation can be carried out rapidly, and it can be achieved simply in the form of a mechanism of which the position indicates whether the bolt is in the closed position —clamping the panel element—or in the open position.

A further advantage of the very great reduction between the operating mechanism and the bolt, when the bolt is in or near its closed position, is that a very great force has to be exerted on the bolt to overcome the friction in the transmission and in the suspension of an operating mechanism connected thereto. This prevents undesirable movement of the bolts from the closed to the open position.

Apart from being used as a ship's door, the panel according to the invention can also be used for other panels which have to be clamped in a sealing manner against a rebate of an opening to be closed, such as doors and hatches of rooms with a controlled atmosphere, such as laboratories.

The panel according to the invention can be adapted either for manual or mechanical driving of the operating mechanism. In the former case the advantage achieved is that operation requires little effort and can be performed even by persons with very little muscle power. From the point of view of safety, it is advantageous here that an action requiring little effort will be less likely to be omitted than an operating action requiring great effort. In the latter case the advantage is that the means for driving the bolt can be made relatively light and cheap.

The invention can also be embodied in a clip system designed for use as a part of a panel according to the invention.

DETAILED DESCRIPTION OF THE INVENTION

Figure 1:
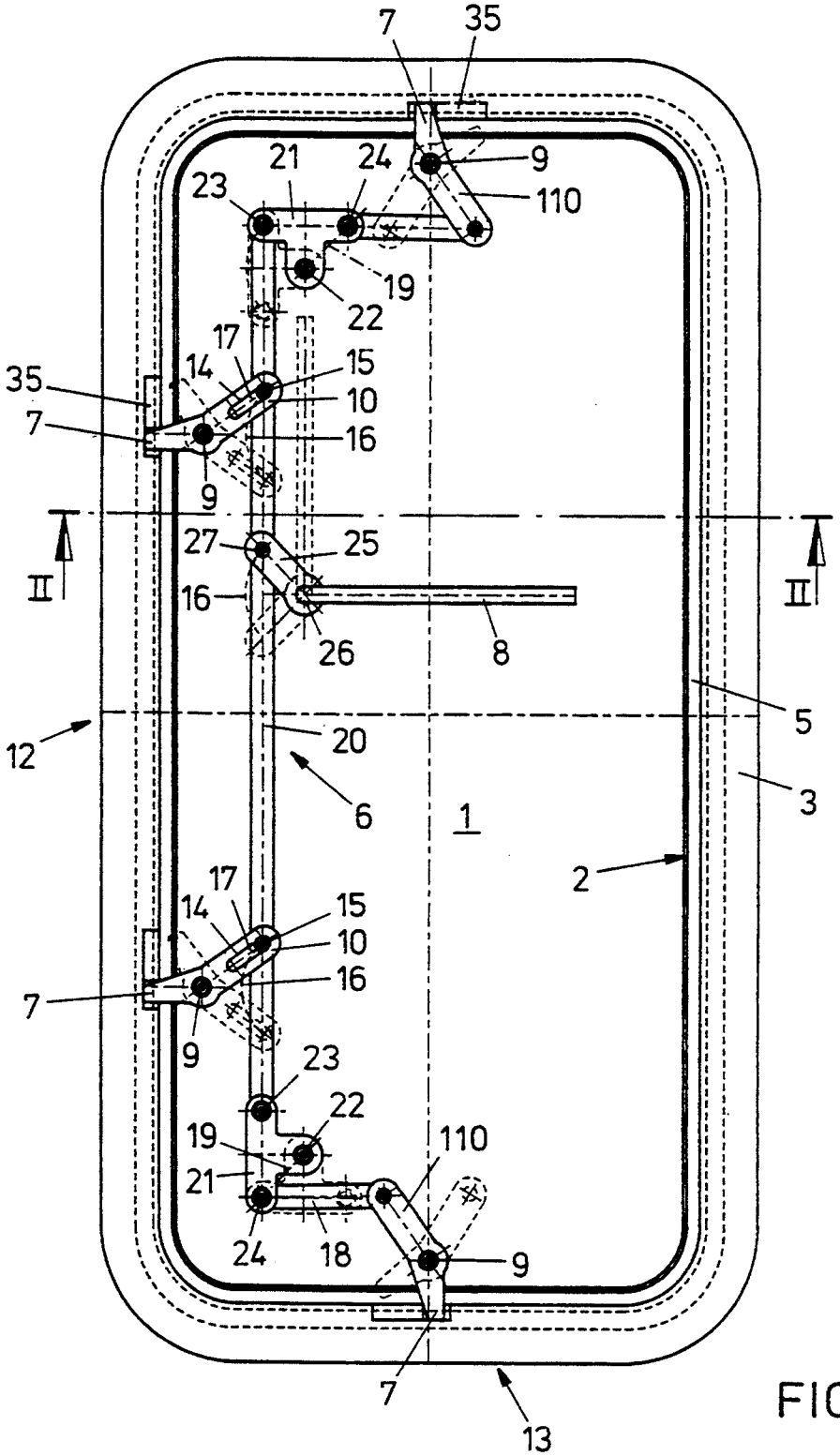
FIG. 1 is a frontal view of the inside of a panel according to a first example of an embodiment of the invention.

Corresponding parts are indicated by the same reference numbers in the drawing.

Figure 2:
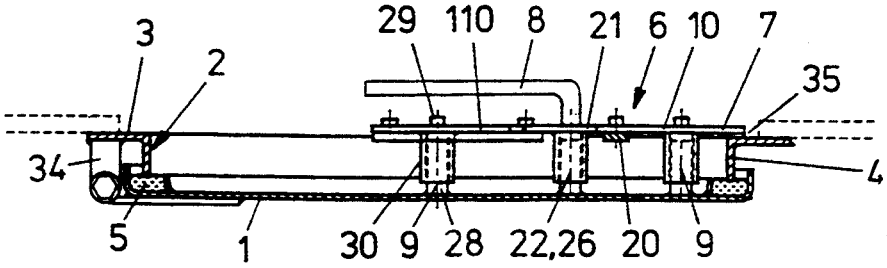
FIG. 2 shows a view in cross-section along the line II—II in FIG. 1.

The most preferred embodiment of the present invention is shown in FIGS. 1 and 2.

A rebate 3 and a panel with a panel element 1 closing an opening 2 are shown in FIGS. 1 and 2. The edge of the opening is formed by a rebate 3 with a raised flange 4, running all the way round, against which a seal 5 of the panel element 1, running all the way round, is clamped. Fixed on the panel element 1 are hinge parts 33 which are hinged to hinge parts 34 fixed to the rebate 3. The panel thus forms a door which can be swung relative to the opening 2.

The panel is equipped with a clip system 6 for clamping the panel element 1 against the rebate 3. The clip system 6 of the panel according to FIGS. 1 and 2 comprises four bolts 7 which are movable between a first position (shown by solid lines) for clamping the panel element 1 against the rebate 3 and a second position (shown by dashed lines) for releasing the panel element 1, and an operating mechanism 8 for moving the bolt 7. The rebate 3 is provided on one side with clip tracks 35 which are bevelled, so that when the bolts 7 are moved to the first position they are forced away from the rebate 3 and thereby clamp the panel element 1 against the other side of the rebate 3. The bolts 7 are preferably provided with bevels corresponding to the bevelled clip tracks 35, so that they can lie against the clip tracks 35 over a great surface area.

The transmission ratio between the operating mechanism 8 and the bolts 7 is variable depending on the position of the bolts 7. The reduction increases as the bolts 7 approach the first position. When the panel element 1 is being clamped against the rebate 3, the reduction between the operating mechanism 8 and the bolts 7 increases as the bolts 7 meet more resistance which is caused by moving the panel element 1 against the increasing force exerted by the flexible sealing section 5. The operation of the bolts 7 therefore requires a limited maximum force.

The reduction is, however, relatively slight in a part of the path in which the bolt 7 encounters little resistance during movement. This means that the operating mechanism 8 need be moved only over a short distance for closure of the bolts 7, with the result that operation can be achieved rapidly. In the case of the operating mechanism 8 the bolts 7 can be operated by swinging the mechanism through an angle of 90°. It can consequently be seen from the operating mechanism 8 whether or not the panel is locked and clamped shut. In the closed position the operating mechanism 8 is directed horizontally. In the open position the operating mechanism 8 is directed vertically.

In the case of the panel according to FIGS. 1 and 2 the reduction in the transmission between the operating mechanism 8 and the bolts increases until the bolts 7 reach the first position. It is, however, also possible to select the course of the transmission ratio in such a way that it becomes negative shortly before the bolts reach the first position, so that in a continuous movement of the operating mechanism 8 the bolts 7 are moved from an extreme dead centre back again over a slight distance. In the process, the panel can swing back again over a short distance from the rebate 4, under the influence of the resilience of the elastic sealing edge 5. A locking of the bolts 7 in the first, closed position can be achieved in this way.

The bolts 7 are connected to levers 10, 110 pivotable about pins 9. The panel element 1 is elongated, and the levers along the long side 12 of the panel element 1 are different in design from the levers along the short side 13 thereof.

The levers 10 along the long side 12 are each provided with a guide strip 14 running essentially in the lengthwise direction, and the clip system 6 has pawls 15 for operating the levers 10 and means for moving said pawls 15 along tracks 16, driven by the operating mechanism 8. Each of the tracks 16 has a part corresponding to paths of the bolts 7 along the long side 12 of the panel element 1 near the first position of said bolts 7, and relative to the corresponding pin 9 having such a course with a radial component that the distance from the pawl 15 to the pin 9 increases as the bolt 7 approaches the first position.

Each of the pawls 15 can cause the respective lever 10 to pivot by exerting a force on the corresponding guide strip 14. Due to the fact that the distance between the pawl 15 and the corresponding pin 9 increases here as the bolt 7 approaches the first position 1, the effective length of the lever 10 gradually increases. Consequently the reduction in the transmission increases and the force exerted on the bolt 7 gradually increases at a certain force exerted by the pawl 15.

In the case of the panel according to FIGS. 1 and 2 a particularly great increase in the reduction is obtained since, moreover, the part of the track 16 corresponding to paths of the bolts 7 along the long side 12 of the panel element 1 near the first position of said bolts 7 runs curved away from the corresponding pin 9. Consequently the angle of the direction of movement of the pawl 15 with the direction of movement of the lever 10 increases rapidly, so that a correspondingly rapidly increasing wedge effect is obtained.

A further advantage of this is that a selfbraking transmission is obtained if, as in the case of the present example of an embodiment, taking into account the coefficient of friction between the pawl 15 and the guide strip 14, a suitable angle is selected between parts of the track 16 of the pawl 15 and of the track of the guide strip in the region of the positions of said pawl 15 and said guide strip 14 which corresponds to a closed position of the bolt 7. The closed bolt 7 can then be operated by exerting a force on the operating mechanism, but when a force is exerted on the closed bolt, other than through the transmission, for opening of the bolt 7, the normal force between the guide strip 14 and the pawl 15 increases in such a way that the friction between them is greater than the corresponding force component exerted parallel to the guide strip 14 on the pawl 15. Movement of the pawl 15 along the guide strip 14 is consequently prevented. Undesirable opening of the bolt 7, for example through vibrations of the construction in which the panel is accommodated is prevented as a result.

The pawls 15 are preferably cylindrical and rotatable about their axes, so that they can roll along the guide strips 14. This limits wear of the pawls and friction between the pawls and the guide strips. The guide strips can have a slightly rough surface, in order to ensure that the pawls always roll and do not glide. The pawls are preferably in each case in the form of a bush of plastic bearing material which is rotatable over a smooth pin.

Since the pawls 15, each belonging to a bolt 7 along the long side 12 of the panel element 1, are coupled for appropriate operation of the levers 10 belonging to the respective bolts 7, the bolts along the long side 12 of the panel element can be operated simultaneously by a common operating mechanism.

The track 16 in each case runs between a position of the pawl 15 corresponding to the first positions of the bolts 7 and a position of the pawl 15 in a circular arc corresponding to the second positions of the bolts 7. Circle sector-shaped tracks can be achieved simply with low-friction guide means, such as arms pivotable about axes.

The bolts can be connected to elements such as springs for pressing said bolts back out of the first positions when the operating mechanism is being or has been operated, for moving the bolts to the second position. According to the example of an embodiment shown in FIGS. 1 and 2, the levers 10 are, however, provided with slits 17, a wall part of which forms the guide strip 14. The pawls 15 can consequently exert forces on the levers 10 for moving the bolts 7 as well to the first positions as to the second positions.

The pawls 15 are fitted on a common pawl support 20, which is movable in translatory motion, so that the two pawls 15 can describe the same paths relative to the long side 12 of the panel element 1 and can drive identical levers 10 and bolts 7.

In order to make each of the pawls 15 move along the circular tracks 16 described above, the pawl support 20 can be moved along an identical circular arc-shaped track 16 as the pawls 15. For driving the pawls 15, the operating mechanism 8 is connected in a simple manner to the pawl support 20 by means of a lever 25 unrotatably connected to the operating mechanism 8. The lever 25 is connected to the pawl support so that it is pivotable about a pin 27 and to the panel element 1 so that it is pivotable about a pin 26. The pin 27 is pivotable along an identical track 16 as the pawls 15. The lever 25 can be connected at virtually any desired place to the vertically directed pawl support 20, so that the position of the operating mechanism 8 can be moved to the optimum height for the users.

The pawl support 20 extends essentially parallel to the long side 12 of the panel element 1, and ends of the circular tracks 16 corresponding to the first and second position of the bolts 7 fitted along the long sides 12 of the panel element 1 lie at equal distances from said side 12 of the panel element 1. The transverse forces exerted on the pawl support 20 consequently remain relatively small, so that it can be in the form of a slim coupling bar extending along levers 10 along the long side 12. The pawl support is connected here to connecting rods which are formed by rocker arms 21, which pivot about pins 22.

The bolts 7 along the short sides 13 of the panel element 1 are hinged by means of the levers 110 thereof to first intermediate rods 18, which are in turn hinged to second intermediate rods (whose axes are indicated by dashed and dotted lines 19) which are hinged to the panel element 1. When the bolts 7 approach the first position, the angles between the displacement directions of the hinge points of the first intermediate rod 18 increase, so that the reduction in the transmission between the operating mechanism 8 and the bolts 7 along the short side 13 of the panel element 1 increases.

Each of the bolts 7 can thus be operated by the operating mechanism 8 with a variable transmission, the reduction of which increases as the bolt 7 in question approaches the first, clamping position. The fact that the bolts 7 can be operated by a single operating mechanism 8 has the advantage that it is ensured that all bolts 7 are operated. It is pointed out that many ship's classifications stipulate the number of bolts of a particular panel, but that this contributes little to safety at sea if in many cases only a number of the bolts are operated for clamping said panel shut.

The pawls 15 for moving the bolts 7 connected to the levers 10 along the long side 12 are preferably connected to the second intermediate rod 19 which is coupled by means of the first intermediate rod to one of the further bolts. The two intermediate rods 19 can consequently be moved in synchronism with the pawls 15 for simultaneous operation of the bolts 7 along the long side 12 and the bolts 7 along the short side 13.

The coupling between the pawls 15 and the second intermediate rods 19 is achieved in a simple manner through the pawl support 20 being coupled to the second intermediate rods 19.

The pawl support 20 is movable along a track 16 parallel to the plane of the panel element 1. The coupling between the pawl support 20 and the second intermediate rod in each case comprises the rocker arm 21, while the pawl support 20 and the first intermediate rod 18 are connected to said rocker arm 21 so that they pivot about a first and a second hinge pin 23, 24 respectively at right angles to the plane of the panel element 1. The rocker arm 21 is connected to the panel element 1 so that it is pivotable about a rocker arm pin 22 at right angles to the plane of said panel element 1.

When the pawl support 20 moves, the rocker arm 21 swings with it about the rocker arm pin 22. The swinging movement of the rocker arm forms the swinging movement of the second intermediate rod 19 which drives the first intermediate rod 18.

Use of first intermediate rods 18 for operating the levers 110 along the short sides 13 of the panel element 1 has the advantage that no special guide of the ends of the first intermediate rods 18 facing away from the rocker arm 21 is needed. This guide is formed by the corresponding levers 110.

The panel according to FIGS. 1 and 2 constitutes an example of an embodiment of the invention which is preferred for a panel with two bolts 7 along one of the long sides 12 and one bolt 7 along each of the short sides 13, with dimensions of $70 \times 150$ cm.

Figure 3:
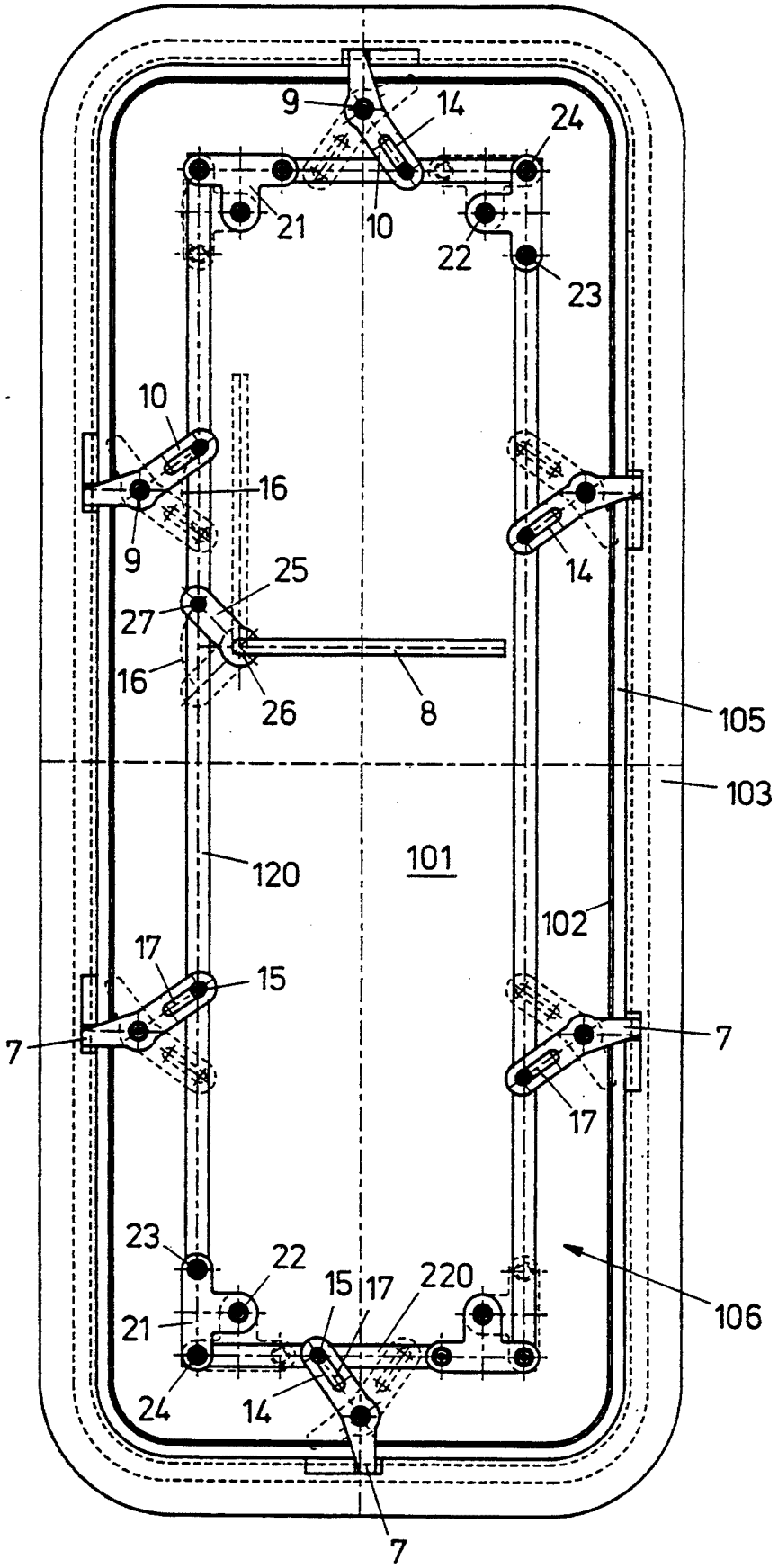
FIG. 3 shows a frontal view of the inside of a panel according to a second example of an embodiment of the invention.

FIG. 3 shows an example of an embodiment of the invention which is preferred if the panel has to be provided with two bolts 7 along each long side and one bolt 7 along each short side.

The panel according to FIG. 3 has pawl supports 120, 220 along both the short and the long sides of the panel element with different dimensions from the panel element 1 shown in FIGS. 1 and 2. The opening 102, the rebate 103 and the sealing section 105 also have corresponding different dimensions. The clip system 106 has pawl supports 120, 220 fitted along all sides of the panel element 101, each of them bearing pawls 15 belonging to the bolts 7 fitted along the respective sides. These pawl supports 120, 220 are interconnected for carrying out corresponding movements relative to the respective sides. This means that all levers 10 can be made identical.

Each of the pawl supports 120, 220 is movable along a path parallel to the plane of the panel element 101. The pawl supports are interconnected by a rocker arm 21 which is identical to the rocker arm 21 shown in FIGS. 1 and 2. The rocker arm 21 also forms a connecting rod by which the pawl supports 120, 220 are connected to the panel element 101, and is connected to the panel element 101 so that it pivots about a rocker arm pin 22 at right angles to the plane of the panel element 101. The pawl supports 120, 220 are connected to the rocker arm 21 at the same distance from the rocker arm pin 22, in such a way that they pivot about hinge pins 23, 24. Planes determined by, on the one hand, the one hinge pin 23 and the rocker arm pin 22 and, on the other, the other hinge pin 24 and the rocker arm pin 22 form an angle which is equal to the angle between the sides of the panel element 101 belonging to the pawl supports 120, 220.

This design makes it possible to connect each pawl support 120, 220 simply to a further pawl support 220, 120 extending at an angle relative to said pawl support 120, 220. In this case these pawl supports 120, 220 are coupled for carrying out identical movements relative to the corresponding sides of the panel element 101. By placing the hinge pins closer together or further away from each other, the rocker arm 21 can be adapted for interconnection of pawl supports 120, 220 extending at more obtuse or more acute angles relative to each other.

If it is desirable to be able to operate the clip system from both sides of the panel element, operating mechanisms are preferably fitted, for example, on both sides of the panel and a passage through the panel element for the clip system is provided only at the position of the operating mechanism on the outside. The chance of leakage is consequently minimised, and costs are saved through the fact that only one sealed passage is needed.

The transmission according to FIGS. 1–3 is, of course, also suitable for panels in which the operating mechanism can operate only one bolt. The pawl 15 is then preferably fitted directly on the lever 25, so that a pawl support with corresponding connecting rods or a first intermediate rod can be omitted. Of course, a panel within the scope of the present invention can also be provided with more or fewer bolts than the panels according to the examples of embodiments described above.

Figure 4:
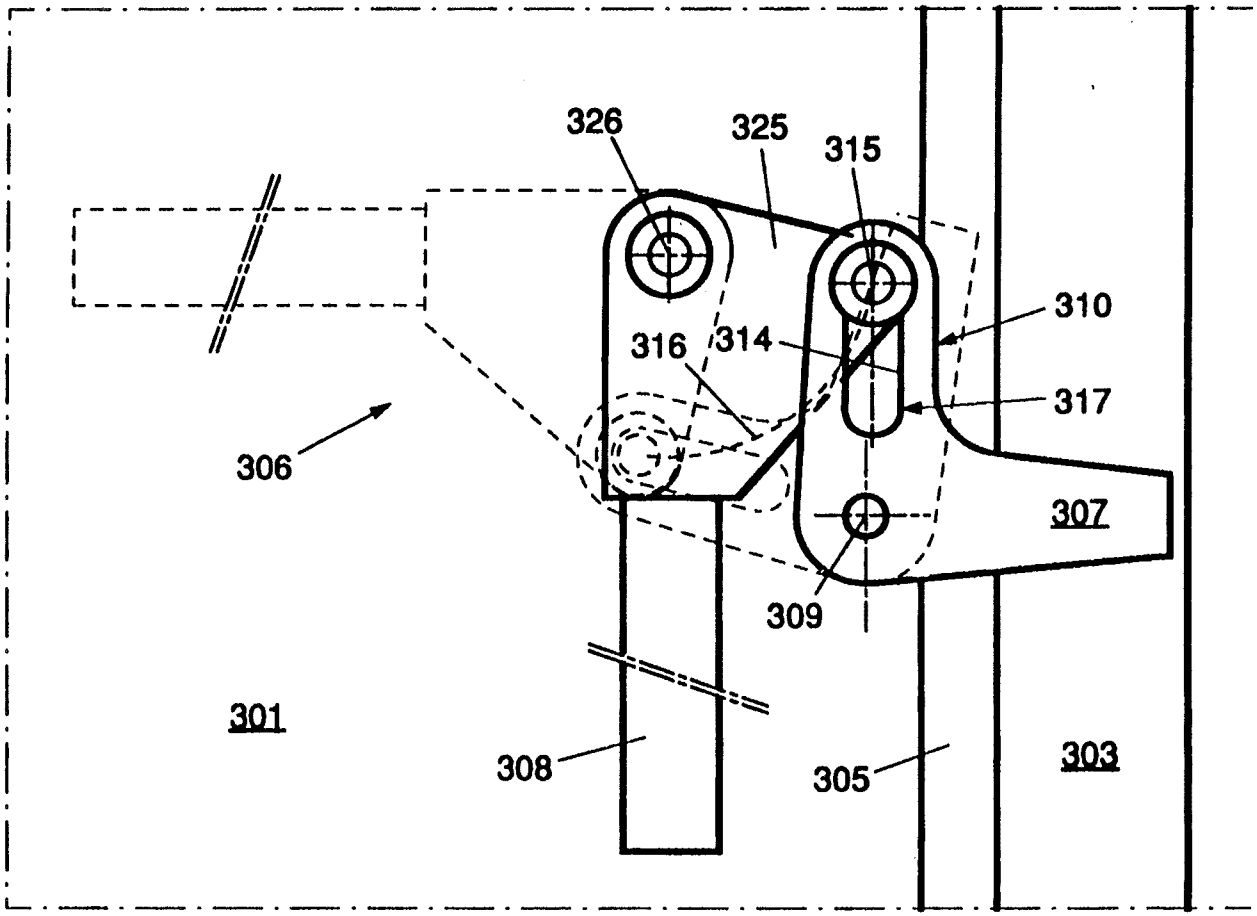
FIG. 4 shows a frontal view of the inside of a part of a panel according to a third example of an embodiment of the invention.
Figure 5:
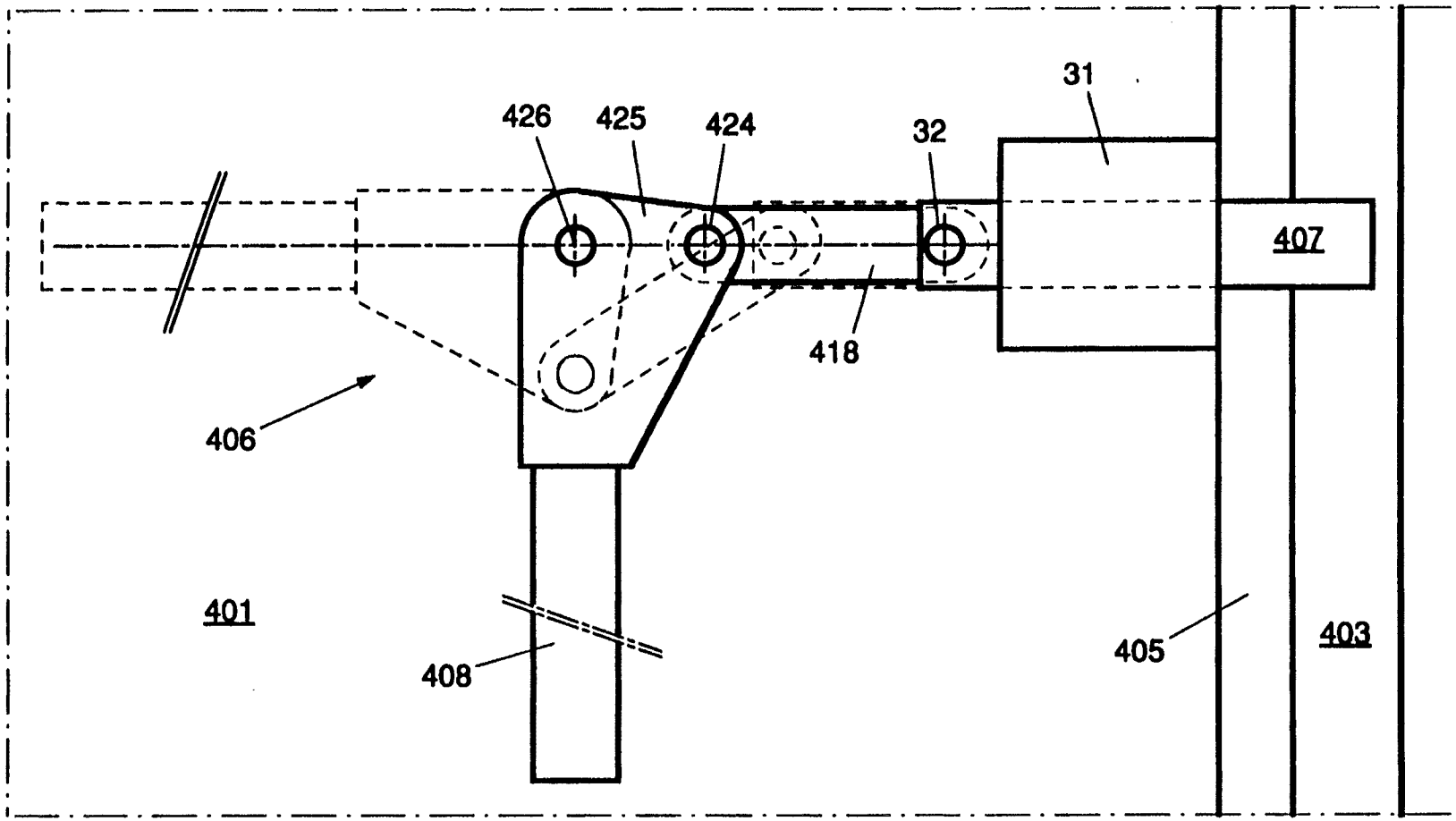
FIG. 5 shows a frontal view of the inside of a part of a panel according to a fourth example of an embodiment of the invention.

FIGS. 4 and 5 show two further examples of embodiments of panels 1 according to the invention, in which one bolt can be operated by the operating mechanism.

In the example of an embodiment according to FIG. 4, the panel closes an opening with a rebate 303 and is equipped with a sealing section 305. The clip system 306 is provided with a pawl 315 which is fixed directly to a lever 325 connected to an operating mechanism 308. A bolt 307 is connected to the panel element 301 in such a way that it pivots about a pin 309. A lever 310 is fixed to the bolt 307, but is at a different angle relative to the bolt than in the case of the levers 10 and the bolts 7 shown in FIGS. 1–3. A slit 317, of which a wall part forms a guide surface 314, is provided in the lever 310. The pawl 315 can glide or roll along said guide surface 314 when the bolt 307 is operated by moving the operating mechanism 308. When the bolt 307 approaches the first position (shown by solid lines), the pawl 315 moves, as in the case of the embodiments shown in FIGS. 1–3, along a circular arc-shaped path 316 which is curved away from the pin 309 of the bolt 307.

The bolts 7, 307 are preferably supported in each case relative to the panel element 1, 101, 301 by means of a bearing 30 (FIG. 2) which is disposed over a pin connection 28 (FIG. 2) fixed to the panel element 1, 101, 301 and provided with a central axially extending and adjustable fixing element 29 (FIG. 2) passing through a coaxial opening in the bolt 7, 307. The clamping force of each of the bolts 7, 307 can thus be adjusted individually in a simple manner.

The bearing 30 is of a length which is at least equal to half the distance between the bolt 7 and the wall of the panel element 1. The result of this is that the maximum pressure in the bearing 28 is kept relatively low, so that the requirements of the bearing material are low. The bearing 30 preferably fits with play, for subsequent adjustment of the distance of the bolt 7 from the panel element 1 and with space possibly for fixing elements of the pin connection, precisely between the bolt 7 and the wall of the panel element 1.

The bearing in this case is preferably self-lubricating, so that it requires little maintenance.

In the example of an embodiment shown in FIG. 5 the panel closes an opening with a rebate 403 and is equipped with a sealing section 405. The clip system 406 comprises a bolt 407 which is suspended so that it slides in a guide 31 relative to the panel element 401, and a first drive rod 418 which is connected at one end by means of a hinge 32 to the bolt 407 and at another end by means of a hinge 424 to a crank 425. The crank 425 is fixed to an operating mechanism 408. The operating mechanism 408 pivots about a pin 426 together with the crank. The crank 425, the drive rod 418 and the bolt 407 form a crank-drive rod mechanism, in which the first, clamping position of the bolt 407 is formed by an extreme position of the bolt lying away from the crank 425. When the bolt 407 is moved away from the first position the reduction in the transmission between the operating mechanism 408 and the bolt 407 gradually decreases, so that the bolt 407 is moved relatively quickly when little resistance needs to be overcome during the movement of the bolt 407.

I claim:

1. A panel for closing an opening, with a panel element and a clip system for clamping said panel element against a rebate of the opening, comprising at least two bolts each movable between a first position for clamping the panel element against a rebate and a second position for releasing the panel element and common operating mechanism for moving said bolt, said operating mechanism comprising at least two levers each pivotable about an axis, connected to a corresponding one of the bolts and provided with a guide strip in an essentially lengthwise direction, at least two pawls each for operating a corresponding one of said levers, and a pawl support onto which said pawls are fitted and movable in curved translatory motion such that the pawls fitted to the pawl support are each movable along a correspondingly curved tract of which a part corresponding to positions of the bolts near the first position is curved away from the pivoting axis of the respective lever and has a course with a radial component relative the pivoting axis of the respective lever such that the distance between corresponding ones of the pawls and the axes increases as the bolts approach said first positions.

2. Panel according to claim 1, wherein the pawl support is movable along a circular arc-shaped track.

3. Panel according to claim 2, wherein the pawl support extends essentially parallel to one side of the panel element, and ends of the circular track corresponding to the first and the second position of the bolts belonging to the pawls of the pawl support lie at equal distances from said side of the panel element.

4. Panel according to claim 3, comprising bolts disposed along at least two sides of the panel element running at an angle relative to each other, and at least two pawl supports each bearing pawls belonging to bolts disposed along one of the sides, the pawl supports being interconnected for carrying out appropriate movements relative to the corresponding sides, wherein each of the pawl supports is movable along a track parallel to the plane of the panel element, the pawl supports are interconnected by a rocker arm which also forms a connecting rod by which the pawl supports are connected to the panel element, which rocker arm is connected to the panel element so that it is pivotable about a rocker arm pin at right angles to the plane of the panel element, while the pawl supports are connected to the rocker arm so that they are pivotable about hinge pins at equal distances from the rocker arm, and planes determined by, on the one hand, the one hinge pin and the rocker arm pin and, on the other hand, the other hinge pin and the rocker arm pin form an angle which is equal to the angle between the sides of the panel element belonging to the pawl supports.

5. Panel according to claim 1, comprising bolts disposed along at least two sides of the panel element running at an angle relative to each other, and at least two pawl supports each bearing pawls belonging to bolts disposed along one of the sides, the pawl supports being interconnected for carrying out appropriate movements relative to the corresponding sides.

6. Panel according to claim 1, wherein said track runs in a circular arc between a position of the pawl corresponding to the first position of the bolt and a position of the pawl corresponding to the second position of the bolt.

7. Panel according to claim 1, wherein the lever is provided with a slit, a wall part of which forms the guide strip.

8. Panel according to claim 1, wherein the clip system has at least two additional bolts to be operated by the operating mechanism, a first one of the additional bolts is hinged to a first intermediate rod which is in turn hinged to a second intermediate rod which is hinged to the panel element, an angle between the displacement direction of the hinge points of the first intermediate rod increases as the bolt approaches the first position in said path, and the pawl for moving a further one of the bolts is connected to the second intermediate rod which is connected by means of the first intermediate rod to said first one of the additional bolts.

9. Panel according to claim 8, wherein the pawl support is connected to the second intermediate rod.

10. Panel according to claim 9, wherein the pawl support is movable along a path parallel to the plane of the panel element, and the second intermediate rod is in the form of a rocker arm, by which the pawl support and the first intermediate rod are connected so that they are pivotable about hinge pins at right angles to the plane of the panel element, which rocker arm is connected to the panel element so that it is pivotable about a rocker arm pin at right angles to the plane of the panel element.

11. Panel according to claim 1, comprising operating means on either side of the panel element, and a passage through the panel element for the clip system is provided only at the position of the operating means on the outside.

12. Panel according to claim 1, wherein the bolt is pivotable about a pin at right angles to the plane of the panel element, and is supported relative to the panel element by means of a bearing which is fitted over a pin connection fixed to the panel element and provided with a central axially extending and adjustable fixing element passing through a coaxial opening in the bolt, the fixing element being axially adjustable.

13. Panel according to claim 12, wherein the bearing is of a length which is at least equal to half the distance between the bolt and the wall of the panel element.

14. Panel according to claim 13, wherein the bearing is made self-lubricating.

15. Clip system for use as a part of a panel for closing an opening comprising at least two bolts each movable between a first position for clamping the panel element, and a common operating mechanism for moving said bolts, said operating mechanism comprising at least two levers each pivotable about an axis, connected to a corresponding one of the bolts and provided with a guide strip in an essentially lengthwise direction, at least two pawls each for operating a corresponding one of said levers, and a pawl support onto which said pawls are fitted and movable in curved translatory motion such that the pawls fitted to the pawl support are each movable along a correspondingly curved tract of which a part corresponding to positions of the bolts near the first position is curved away from the pivoting axis of the respective lever and has a course with a radial component relative the pivoting axis of the respective lever such that the distance between corresponding ones of the pawls and the axes increases as the bolts approach said first positions.

* * * * *

UNITED STATES PATENT AND TRADEMARK OFFICE

CERTIFICATE OF CORRECTION

PATENT NO. : 5,333,920
DATED : August 2, 1994
INVENTOR(S) : Jan de Rover

It is certified that error appears in the above-indentified patent and that said Letters Patent is hereby corrected as shown below:

At Column 10, at line 38, insert before the "," the following:

---against a rebate and a second position for releasing the panel element---

Signed and Sealed this

Fourth Day of October, 1994

*Attest:*

*Attesting Officer*

Bruce Lehman

BRUCE LEHMAN

*Commissioner of Patents and Trademarks*